US005630301A

United States Patent [19]

Sieg

[11] Patent Number: 5,630,301

[45] Date of Patent: May 20, 1997

[54] ANCHORAGE ASSEMBLY AND METHOD FOR POST-TENSIONING IN PRE-STRESSED CONCRETE STRUCTURES

[75] Inventor: Lyle D. Sieg, Delta, Canada

[73] Assignee: Harris P/T, A Division of Harris Steel Limited, Stoney Creek, Canada

[21] Appl. No.: 450,024

[22] Filed: May 25, 1995

[51] Int. Cl.[6] ..... E04C 5/08

[52] U.S. Cl. ..... 52/223.13; 52/223.14; 52/745.21; 24/136 R; 24/115 M; 277/177

[58] Field of Search ..... 52/223.13, 223.14, 52/745.21; 24/136 R, 122.3, 115 M; 277/174, 177, 207 A

[56] References Cited

U.S. PATENT DOCUMENTS

| | | | |
|---|---|---|---|
| Re. 34,350 | 8/1993 | Dufossez | 52/223.13 X |
| 3,218,051 | 11/1965 | Doetsch | 277/177 X |
| 3,516,211 | 6/1970 | Rieve | 52/223.14 X |
| 3,596,330 | 8/1971 | Richmond et al. | 24/115 M X |
| 3,757,390 | 9/1973 | Edwards . | |
| 3,844,697 | 10/1974 | Edwards | 52/223.13 X |
| 4,180,346 | 12/1979 | Blake | 24/136 R X |
| 4,343,122 | 8/1982 | Wlodkowski et al. | 52/223.13 |
| 4,426,095 | 1/1984 | Buttner | 277/207 A |
| 4,662,134 | 5/1987 | Illgner | 52/223.13 |
| 4,744,691 | 5/1988 | Thal | 52/223.13 X |
| 4,917,390 | 4/1990 | Lee et al. | 277/177 X |
| 5,347,777 | 9/1994 | Sudduth . | |
| 5,369,849 | 12/1994 | De France | 24/115 M X |

FOREIGN PATENT DOCUMENTS

| | | | |
|---|---|---|---|
| 985016 | 3/1976 | Canada | 52/223.13 |

*Primary Examiner*—Wynn E. Wood
*Assistant Examiner*—Aimee E. McTigue

[57] ABSTRACT

An anchorage assembly for post-tensioning a tendon in a pre-stressed concrete structure, comprises an anchor having a bore for receiving the tendon, the bore comprising a first bore portion which is convergent inwardly of the anchor and a second bore portion. Wedges are in wedging engagement between the first bore portion and the tendon to retain the tendon, and a seal is engaged between the second bore portion and the tendon, the seal having a wedge-shaped cross-section and being compressed by a wedging action between and into sealing engagement with the second bore portion and the tendon.

7 Claims, 2 Drawing Sheets

ANCHORAGE ASSEMBLY AND METHOD FOR POST-TENSIONING IN PRE-STRESSED CONCRETE STRUCTURES

BACKGROUND OF THE INVENTION

1. Field of the Invention

The present invention relates to an anchorage assembly for a pre-stressed concrete tendon, for use in past tensioning a pre-stressed concrete structure, and to a method of anchoring a tendon for use in post-tensioning the tendon in pre-stressed concrete.

2. Description of the Related Art

In the construction of pre-stressed concrete structures, anchorage assemblies are provided at opposite ends of a cables, commonly referred to as tendons, extending through the concrete structure. The anchorage assemblies comprise anchors which are embedded in the concrete and which are formed with bores for receiving the tendon ends. Wedges inserted into the anchor bores serve to retain the tendon ends relative to the anchors.

In U.S. Pat. No. 3,757,390, issued Sep. 11, 1973, to Hugh Jeremy Willis Edwards, there is described an anchorage assembly such as that described above, which is additionally provided with a sealing element of flexible material. The sealing element is inserted by means of a special tool into the bore and is formed with an external annular rib, which engages in and is retained by an annular recess formed in the bore. This sealing element serves to prevent the ingress of concrete into the bore of the anchor by filling the annular space between the periphery of the bore and the tendon. The sealing element comprises an annulus of flexible material having a bore which is preferably formed to conform to the outer periphery of the tendon and the annulus is split, or capable of being split, radially to facilitate positioning thereof over the tendon.

When this prior anchorage assembly is in use, the tendon is threaded through the bore of the anchor, which is attached to the shuttering. The sealing member is then clipped over the cable, and the special tool referred to above is employed to force the sealing member into the end of the anchor bore. Due to the relative tolerances of the bore and the outer diameter of the sealing member, and due to the compressibility of the sealing member, the sealing member is sufficiently compressed to be forced into the bore until its annular projection or rib becomes tightly engaged in the recess in the anchor bore.

It is a disadvantage of this prior arrangement that the special tool is required for this purpose. It is accordingly an object of the present invention to facilitate the provision of a seal between the anchor bore and the tendon without the use of a special tool and without the provision of an annular projection or rib for engagement in an annular recess in the bore.

BRIEF SUMMARY OF THE INVENTION

According to the present invention, an anchorage assembly for post-tensioning a tendon in a pre-stressed concrete structure comprises a post-tensioning anchor and a seal which has a wedge-shaped cross-section by means of which the seal is compressed, by a wedging action, between and into sealing engagement with a portion of a bore in the anchor and the tendon.

In use, the seal is inserted into the bore so that the outer surface of the seal is seated snugly against the bore. The tendon is then inserted into the anchor bore and through the seal. As the end of the tendon is forced through the seal, the tendon frictionally engages an inner surface of the seal and thereby causes the seal to be deformed from its initial, non-stressed shape, by the above-mentioned wedging action, into compression between the anchor bore and the outer surface of the tendon. The seal then serves to prevent moisture from passing along the anchor bore.

BRIEF DESCRIPTION OF THE INVENTION

Further features, objects and advantages of the present invention will be more readily apparent from the following description thereof when taken in conjunction with the accompanying drawings, in which.

DESCRIPTION OF THE PREFERRED EMBODIMENT

Figure 1:
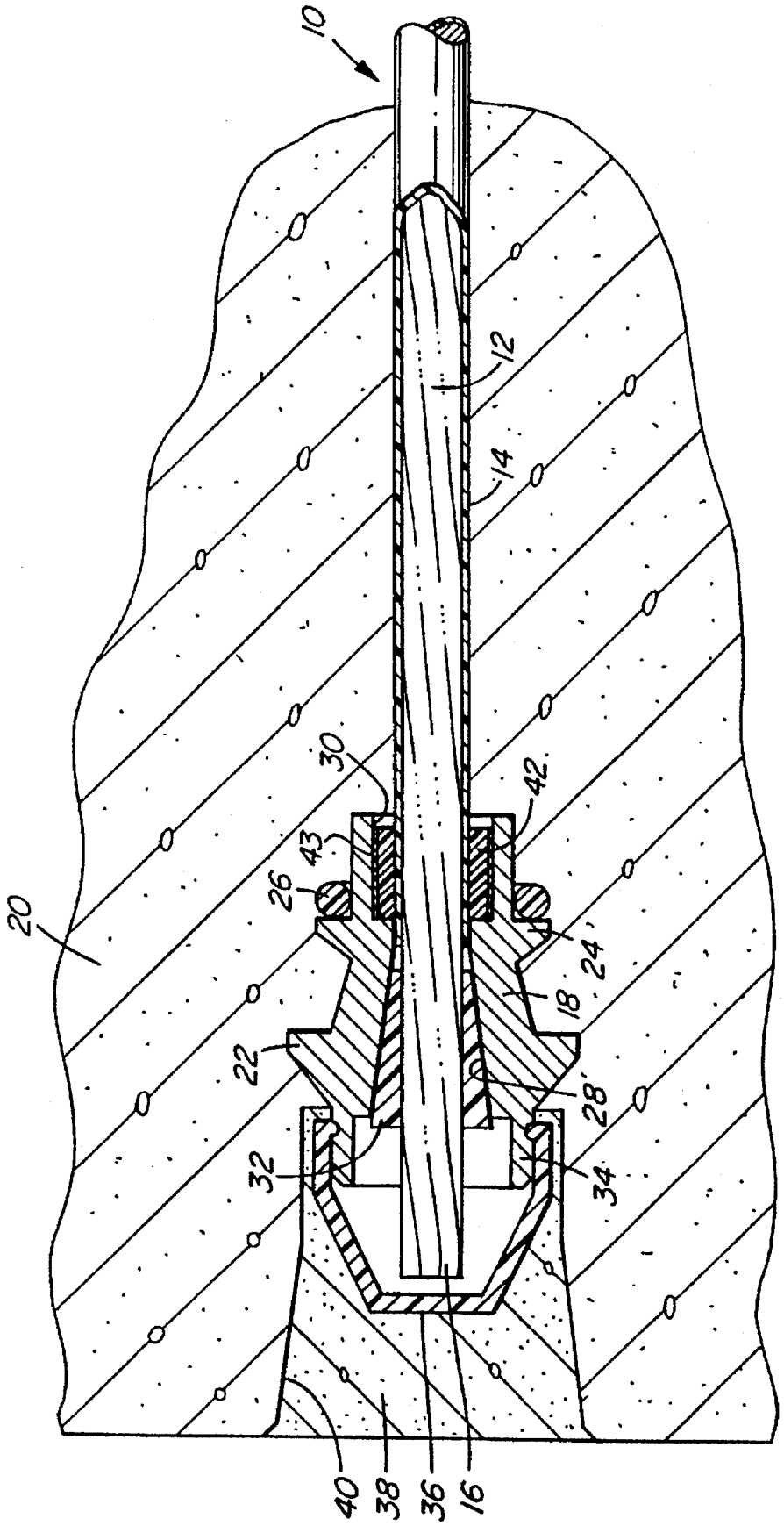
FIG. 1 shows a view taken in longitudinal cross-section through a tendon anchorage assembly in a post-tensioned concrete structure.

Referring firstly to FIG. 1 of the accompanying drawings, reference numeral 10 indicates generally a tendon, which comprises a mono-strand cable 12 covered with grease (not shown) and which has an extruded plastic sheath 14 to protect the strands of the cable 12. The tendon 10 has an end 16 inserted through an anchor 18, which is embedded in concrete 20.

The anchor 18 is formed with outwardly extending annular projections 22 and 24, and the projection 24 abuts edge bars 26 embedded in the concrete 20 to assist in retaining the anchor 18 against tension in the tendon 10.

The anchor 18 has a tapered first bore portion 28, which is convergent inwardly of the anchor 18, and a second bore portion 30, which is cylindrical. Wedges 32 inserted into the first bore portion 28 are in wedging engagement with the cable 12 and with the anchor 18 for retaining the cable end 16 from being withdrawn from the anchor 18.

The left-hand end of the anchor 18, as viewed in FIG. 1, has a cylindrical extension 34, which serves to engage in a grease-filled cap 36 of plastic material. As will be apparent to those skilled in the art, the cap 36 serves to prevent entry into the anchor 18 of a mortar grout 38, which is inserted into a recess 40 in the concrete 20 after the tensioning of the tendon 10.

The second bore portion 30 has a diameter which is sufficiently greater than that of the tendon 10 to accommodate a compression seal 42 between the second bore portion 30 and the sheath 14 of the tendon 10. The seal 42 is secured to the second bore portion 30 by layer 43 of adhesive, on insertion of the seal 42 into the second bore portion 30.

Figure 2:
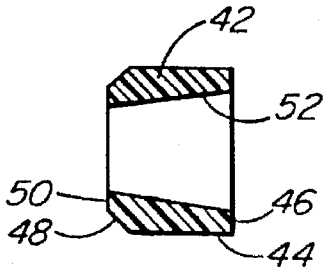
FIG. 2 shows a view taken in axial cross-section through a seal forming part of the assembly of FIG. 1.

FIG. 2 illustrates the cross-sectional shape of the seal 42 before compression of the seal 42 between the second bore portion 30 and the tendon 10. As shown in FIG. 2, the seal 42 has a cylindrical outer surface 44 which extends from a flat annular end surface 46 to a bevel 48, which in turn extends to a flat annular opposite end surface 50. The seal 42 also has a frusto-conical or annular convergent inner surface 52 which tapers from the end surface 46 to the end surface 50, i.e. towards the first bore portion 28.

Figure 3:
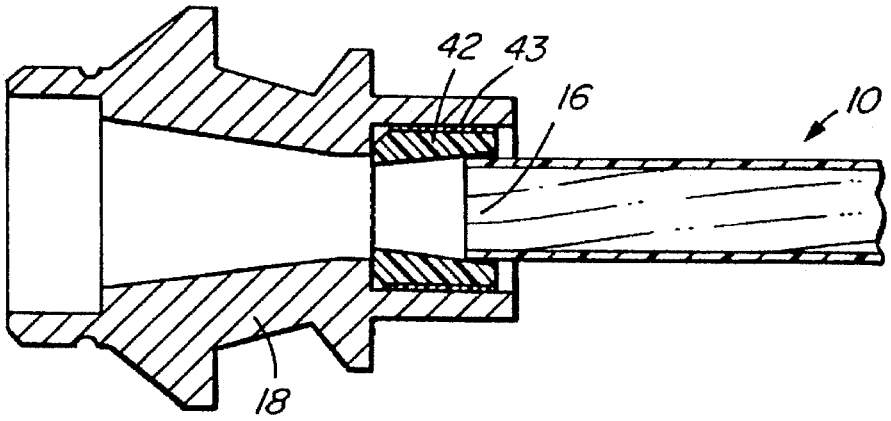
FIGS. 3 and 4 show two similar views taken in axial cross-section through the anchor and seal of the assembly of FIG. 1 before and after, respectively, the insertion of a tendon end through the anchor.

FIG. 3 shows the seal 42 in an uncompressed condition in the second bore portion 30 of the anchor 18 before insertion of the tendon end portion 16 through the seal 42. As can be seen from FIG. 3, in this condition the seal 42 has a wedge-shaped cross-section, the inner surface 52 of the seal 42 is convergent inwardly of the anchor 18, and the internal diameter of the seal 42, at the end face 50, is somewhat less than the diameter of the tendon end portion 16.

Consequently, as the tendon end portion 16 is pushed through the seal 42, the inner surface 52 of the seal 42 is frictionally engaged by the sheath 14 on the tendon end portion 16. As the tendon end portion 16 is forced through and beyond the seal 42, the seal 42 becomes wedged between the second bore portion 30 and the outer surface of the sheath 14, and the consequential wedging action causes the seal 42 to be compressed into tight sealing engagement with the sheath 14 and the anchor 18.

Figure 4:
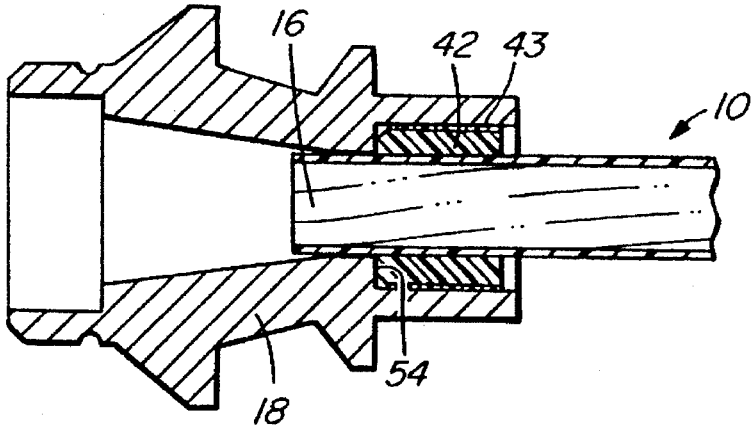

As can be seen in FIGS. 3 and 4 the inner end of the second bore portion 30 terminates at an annular shoulder 54 against which one end of the seal 42 abuts and, which serves as a stop to prevent the seal 42 from being dragged further into the anchor 18 beyond the second bore portion 42.

The sheath 14 is subsequently removed from an end portion of the cable 12, as shown in FIG. 1, before the wedges 32 are inserted into wedging engagement with the cable 12 and the anchor 18.

As will be apparent to those skilled in the art, various modifications may be made to the above-described anchorage assembly within the scope and spirit of the appended claims.

I claim:

1. A pre-stressed concrete tendon anchorage assembly, comprising:

an anchor;

said anchor having a bore extending through said anchor;

said bore having a first bore portion and a second bore portion and said first bore portion converging towards said second bore portion;

a tendon extending through said bore, said tendon having a sheath and an end portion from which said sheath is removed;

said second bore portion having a bore surface spaced from said sheath;

an annular seal of resilient material;

said annular seal having an annular inner surface and being located in said second bore portion between said sheath and said bore surface of said second bore portion;

an adhesive bonding said annular seal to said anchor;

said annular seal having a wedge-shaped cross-section, when in an uncompressed state, and being compressed by a wedging action by said tendon into sealing engagement with said sheath and said anchor so as to seal said sheath to said anchor; and wedges located in said first bore portion at a spacing from said annular seal and in wedged engagement with said end portion of said tendon to retain said tendon relative to said anchor.

2. An anchorage assembly as claimed in claim 1, further comprising an annular shoulder in said bore between said first and second bore portions, said annular seal having one end thereof in abutment with said shoulder to prevent said annular seat from being drawn into said first bore portion.

3. An anchorage assembly as claimed in claim 2 wherein said annular seal has, in the uncompressed state thereof, an annular inner surface which is convergent towards said one end of said annular seal.

4. An anchorage assembly as claimed in claim 1, wherein said annular seal has, in an uncompressed state thereof, an annular inner surface which is convergent towards said first bore portion.

5. A tendon anchorage assembly for use in pre-stressing concrete, comprising:

an anchor;

said anchor having a bore extending through said anchor;

said bore a having a tapered first bore portion and a cylindrical second bore portion and said first bore portion converging towards said second bore portion;

a tendon extending through said bore, said tendon having a sheath and an end portion from which said sheath is removed;

an annular seal of resilient material;

said annular seal having a cylindrical outer surface and an annular inner surface and being located in said second bore portion;

a layer of adhesive bonding said annular seal to said second bore portion;

said tendon adapted to be inserted through said annular seal into said first bore portion and said annular seal thereby adapted to be compressed by said tendon from an uncompressed state, in which said annular seal has a wedge-shaped cross-section and said inner annular surface converges towards said first bore portion, into a cylindrical compressed state in sealing engagement with said sheath and said anchor; and wedges located in said first bore portion at a spacing from said annular seal and in wedged engagement with said end portion of said tendon to retain said tendon relative to said anchor.

6. An anchorage assembly as claimed in claim 5, further comprising an annular shoulder in said bore between said first and second bore portions, said annular seal having one end thereof in abutment with said shoulder to prevent said annular seal from being drawn into said first bore portion.

7. A method of anchoring a tendon for use post-tensioning the tendon in pre-stressed concrete, which comprises the steps of:

inserting an annular seal into an anchor, the annular seal having a wedge-shaped cross-section with a convergent annular inner surface;

bonding said annular seal to said anchor by an adhesive;

subsequently inserting said tendon through said annular seal in said anchor so as to thereby compress said annular seal between a sheath on said tendon and said anchor into sealing engagement with said sheath and said anchor; and subsequently securing said tendon to said anchor by wedging said tendon to said anchor by wedges spaced from said annular seal.

* * * * *